US006069603A

United States Patent [19]

Knapp

[11] Patent Number: 6,069,603

[45] Date of Patent: May 30, 2000

[54] METHOD OF DRIVING A MATRIX DISPLAY DEVICE

[75] Inventor: Alan G. Knapp, Crawley, United Kingdom

[73] Assignee: U.S. Philips Corporation, New York, N.Y.

[21] Appl. No.: 08/618,390

[22] Filed: Mar. 19, 1996

Related U.S. Application Data

[63] Continuation of application No. 08/406,823, Mar. 20, 1995, abandoned, which is a continuation of application No. 08/209,663, Mar. 10, 1994, abandoned.

[30] Foreign Application Priority Data

Mar. 18, 1993 [GB] United Kingdom ..... 9305608

[51] Int. Cl.[7] ..... G09G 3/36

[52] U.S. Cl. ..... 345/91; 345/96

[58] Field of Search ..... 345/94, 84, 58, 345/87, 55, 96, 100, 214, 208, 211, 204, 91, 104, 89; 349/49, 33

[56] References Cited

U.S. PATENT DOCUMENTS

| | | | |
|---|---|---|---|
| 4,560,982 | 12/1985 | Sonehara et al. | 345/204 |
| 4,640,582 | 2/1987 | Oguchi et al. . | |
| 4,873,516 | 10/1989 | Castleberry . | |
| 4,945,352 | 7/1990 | Ejiri . | |
| 5,014,048 | 5/1991 | Knapp . | |
| 5,025,250 | 6/1991 | Hains | 345/211 |
| 5,032,831 | 7/1991 | Kuijk | 345/208 |
| 5,159,325 | 10/1992 | Kuijk et al. . | |

FOREIGN PATENT DOCUMENTS

| | | |
|---|---|---|
| 0523797 | 1/1993 | European Pat. Off. . |
| 63-307433 | 12/1988 | Japan . |
| 2-111919 | 4/1990 | Japan . |
| 2-146523 | 6/1990 | Japan . |

*Primary Examiner*—Jeffery Brier
*Attorney, Agent, or Firm*—John C. Fox

[57] ABSTRACT

A method of driving a matrix display device having an array of electro-optic display elements (12) each of which is connected in series with a two terminal non-linear device (15), such as a MIM, between associated row and column address conductors (16,17), in which the display elements are driven in a reset mode of operation by applying to the column address conductors data signals (D) and to the row address conductors selection signals (Vs) and reset signals (Va) to correct for non-uniformities in the characteristics of the non-linear devices, and in which in a row address period (T1) a data signal (D) applied to a column conductor is preceded by its inverse ($\bar{D}$), a reset signal (Va) is applied during the application of the inverse data signal, and a selection signal (Vs+) is applied during the application of the data signal in the latter part of the row address period in order to minimize differences in ageing of the non linear devices.

11 Claims, 3 Drawing Sheets

METHOD OF DRIVING A MATRIX DISPLAY DEVICE

This is a continuation of application Ser. No. 08/406,823, filed Mar. 20, 1995, now abandoned, which is a continuation of application Ser. No. 08/209,663, filed Mar. 10, 1994 now abandoned.

BACKGROUND OF THE INVENTION

This invention relates to a method of driving a matrix display device comprising sets of row and column address conductors, a row and column array of electro-optic display elements operable to produce a display, each of which is connected in series with a two terminal non-linear device between a row conductor and a column conductor, in which each row of display elements is driven by applying during a respective row address period a selection voltage signal to a row conductor to select the row of display elements and data voltage signals to the column conductors to drive each display element to produce a required display effect, in which, prior to the application of a selection voltage signal and a data voltage signal which are operable to charge a selected display element to a voltage of predetermined sign and magnitude at which the required display effect is obtained, the display element is charged to an auxiliary voltage of the same sign and greater magnitude. The invention relates also to a matrix display device drivable by such a method.

The display device may be used to display alpha-numeric or video information and the two terminal non-linear devices can be of various forms, such as diode rings, back to back diodes, MIMs, etc. which are bidirectional and substantially symmetrical. The display elements, for example, liquid crystal display elements, are addressed by sequentially applying a selection voltage signals to each one of the first set of address conductors in turn and applying in synchronised manner data signals to the other set as appropriate to drive the display elements to a desired display condition which is subsequently maintained until they are again selected in a following field period.

A method of driving a display device of the above kind is described in U.S. Pat. No. 5,159,325. In this method a five level row scanning signal is employed which includes a reset voltage signal in addition to the usual selection signals and non-selection (hold) levels. The selection and hold levels are polarity inverted for successive fields and, together with the reset voltage signal, which may be regarded as an additional selection signal, require a five level signal waveform. Before presenting a selection signal which together with the data signals provides the display elements of a row with a voltage of a certain sign, the display elements are charged through their non-linear devices having an approximately symmetrical I-V characteristic to an auxiliary voltage level of the same sign and which lies at or beyond the range of voltage levels (Vth to Vsat) used for display. During the application of the reset voltage the voltage applied to the column conductors may be set to zero volts. This method leads to a reduction of non-uniformities (grey variations) in the transmission characteristics of display elements which can otherwise occur when driving the rows with periodical inversion of the polarity of both the selection and the non-selection signals, simultaneously with inversion of the data signals. As described in that specification, the applied drive voltages can be arranged such that during a number of successive selection signals in successive fields applied to a row of display elements, which can include selection signals which are not preceded by a reset voltage for charging the display elements to an auxiliary voltage level, the current through the associated non-linear devices during selection periods has the same direction.

The drive scheme of U.S. Pat. No. 5,159,325 helps to compensate for the effects of non-uniformities in the operating characteristics of the non-linear devices of the display device.

Ideally, the non-linear devices of the display device should demonstrate substantially similar threshold and I-V characteristics so that the same drive voltages applied to any display element in the array produce substantially identical visual results. Differences in the thresholds, or turn-on points, of the non-linear devices can appear directly across the electro-optical material producing different display effects from display elements addressed with the same drive voltages. Serious problems can arise if the operational characteristics of the non-linear devices drift over a period of time through ageing effects causing changes in the threshold levels. The voltage appearing across the electro-optic material depends on the on-current of the non-linear device. If the on-current changes during the life of the display device then the voltage across the electro-optic material also changes. This change may either be in the peak to peak amplitude of the voltage or in the mean d.c. voltage depending on the actual drive scheme. The consequential change in display element voltages not only leads to inferior display quality but can cause an image storage problem and also degradation of the LC material.

In European Patent Specification EP-A-0523797 there is described a similar display device which further includes a reference circuit which comprises a capacitor connected in series with a non-linear device like those of the display elements and to which is applied drive signals similar to those applied to the display elements. Changes in the way in which the non-linear device of the reference circuit behaves reflect behavioural changes in the non-linear devices of the display elements and by monitoring the characteristics of the non-linear device of the reference circuit, correction can be made so as to compensate for the corresponding changes in the on-current of the display element non-linear devices due to ageing processes. To this end, a reference voltage is applied to the reference circuit simulating a data signal which corresponds to a predetermined average data signal level or is derived from actual data signals applied to column conductors over a period of time.

The effects of ageing of many non-linear devices, for example silicon nitride MIMs, are dependent to a large extent on the manner in which the device is operated. Changes in the device's operating characteristics are determined by the voltage levels to which the display element is driven. Driving a display element to higher values causes larger currents to flow through the non-linear device with the result that the rate of ageing is increased. The scheme described in EP-A-0523797 for correcting drift in the non-linear devices can compensate for the ageing of the non-linear devices driven to a single drive level. In practice, however, the ageing of the non-linear devices associated with picture elements which, in the case of LC display elements, are driven fully on (non-transmissive) and fully off (transmissive), e.g. black and white respectively, can be significantly different. Because the non-linear device of the reference circuit is driven at an intermediate, i.e. average, level it ages at a rate intermediate between the two extremes.

SUMMARY OF THE INVENTION

According to one aspect of the present invention a method of driving a matrix display device as described in the opening paragraph is characterised in that during a row address period the data voltage signal for a display element is applied during a latter part of the row address period and a signal comprising the inverse of the data signal is applied during a preceding part of the row address period with the display element being driven to said auxiliary voltage during the application of the inverse data signal in the row address period, and in that the selection voltage signal is applied during the application of said data signal in the latter part of the row address period.

With this method the difference in ageing of non-linear devices of display elements driven to different levels is minimised. It has been found that when driving a display device using the aforementioned five level row waveform drive scheme the difference in the ageing rates for non-linear devices associated with black and white liquid crystal display elements in the middle of plain areas of the display is determined only by the difference in capacitance of these display elements. However, the non-linear devices associated with display elements located at the horizontal transitions between black and white display regions or vice versa may age much more or much less than those associated with other display elements. The method of the present invention helps to avoid this effect.

In a preferred embodiment of the invention, the data signal and the inverse data signal are applied for substantially equal periods during a row address period in order to reduce cross-talk effects most effectively. The duration of the selection voltage signal is less than but preferably close to one half of the row address period, thus effectively maximising the time allowed for charging the display elements to the required levels.

In order to reduce the overall flicker effects in the display image the array of display elements is preferably driven in a line inversion mode of operation in which the drive voltages applied to one row of display elements are shifted over one field period plus a row address period with respect to those for an adjacent row of display elements and the data signals are inverted for successive rows.

According to another aspect of the present invention, there is provided a matrix display device comprising sets of row and column address conductors, a row and column array of electro-optic display elements for producing a display, each of which display elements is connected in series with a two terminal non-linear device between a row conductor and a column conductor and a drive circuit connected to the sets of row and column address conductors for applying a selection voltage signal to each row address conductor during a respective row address period to select the row of display elements and data voltage signals to the column conductors to drive each display element to produce a required display effect, and in which the drive circuit is arranged also to charge a display element to an auxiliary voltage prior to the application to that display element of a selection voltage signal and a data voltage signal for driving the selected display element to a voltage of predetermined sign and magnitude to obtain the required display effect, which auxiliary voltage is of the same sign and greater magnitude, characterised in that the drive circuit is arranged to apply in a a row address period the data voltage signal for a display element and the inverse of the data signal to its associated column address conductor during respectively a latter part of the row address period and a preceding part of the row address period, the drive circuit being operable to charge the display element to said auxiliary voltage during the application of the inverse data signal in the row address period and to apply the selection voltage signal during the application of said data signal in the latter part of the row address period.

BRIEF DESCRIPTION OF THE DRAWING

A method of driving a matrix display device, comprising a liquid crystal display device, and a display device operable by such method, in accordance with the present invention will now be described, by way of example, with reference to the accompanying drawings, in which.

DESCRIPTION OF THE PREFERRED EMBODIMENTS

Figure 1:
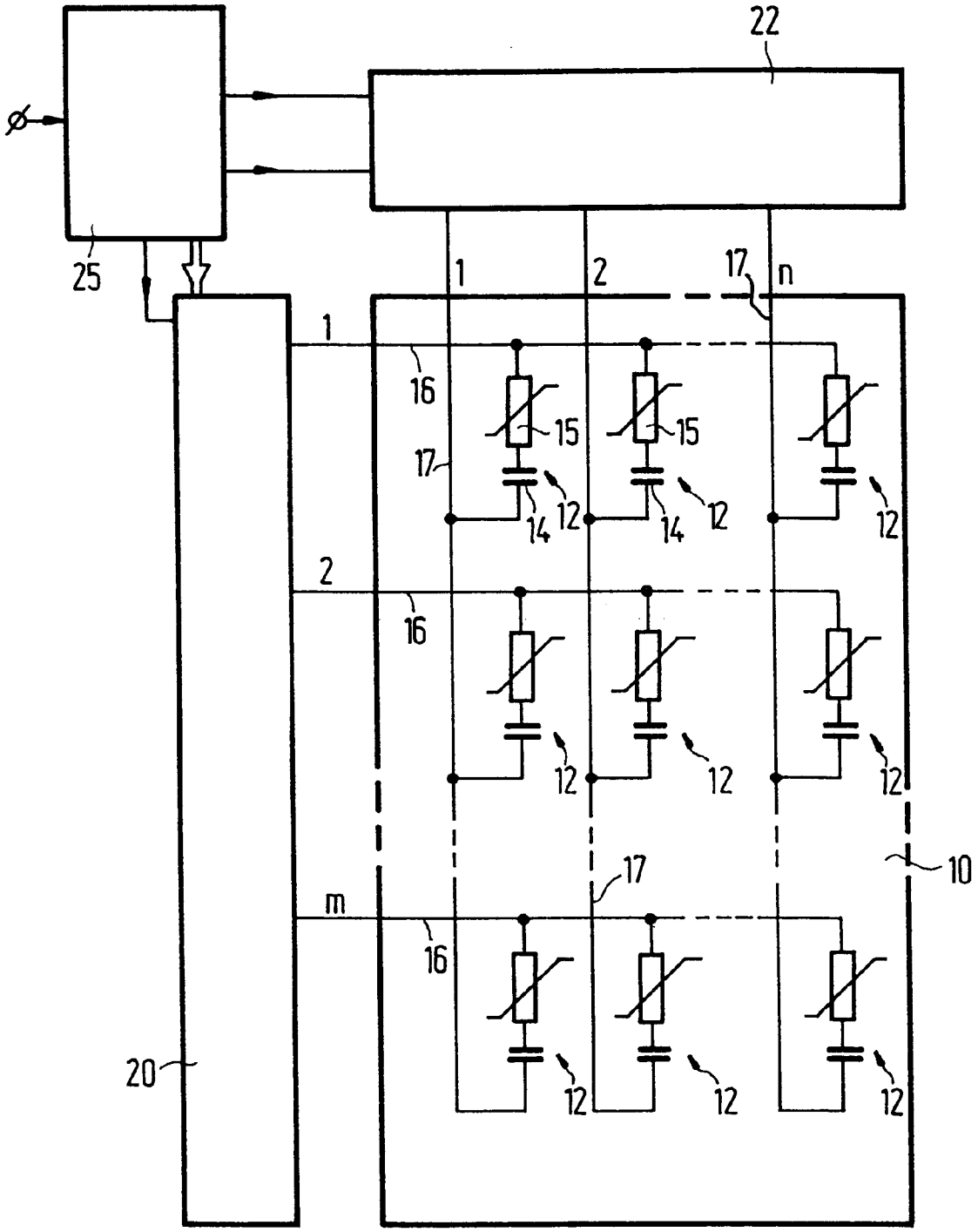
FIG. 1 is a simplified schematic block diagram of a matrix LC display device in which a method according to the present invention is used.

Referring to FIG. 1, the display device is intended for datagraphic display and comprises an active matrix addressed liquid crystal display panel 10 of conventional construction and consisting of m rows (1 to m) with n picture elements 12 (1 to n) in each row. Each picture element 12 consists of a twisted nematic liquid crystal display element 14 connected electrically in series with a bidirectional non-linear resistance device 15, which exhibits a threshold characteristic and acts as a switching element, between a row conductor 16 and a column conductor 17. The display elements 12 are addressed via sets of row and column conductors 16 and 17 carried on respective opposing faces of two, spaced, glass supporting plates (not shown) also carrying the opposing electrodes of the liquid crystal display elements. The devices 15 are provided on the same plate as the set of row conductors 16 but could instead be provided on the other plate and connected between the column conductors and the display elements.

The row conductors 16 serve as scanning electrodes and are addressed by a row driver circuit 20 which applies a scanning signal, comprising a selection voltage signal component, to each row conductor 16 sequentially in turn. In synchronism with the scanning signals, data signals are applied to the column conductors 17 from a column driver circuit 22 to produce the required display from the rows of display elements associated with the row conductors 16 as they are scanned. The selection voltage signal component occurs in a row address period in which the optical transmissivity of the display elements 14 of the row are set to produce the required visible display effects according to the data signals present on the conductors 17. The individual display effects of the display elements 14, addressed one row at a time, combine to build up a complete picture in one field, the display elements being refreshed in a subsequent field. Using the transmission/voltage characteristics of a liquid crystal display element grey scale levels can be achieved. The display elements are addressed using a line inversion mode of drive to reduce perceived flicker. In addition the polarity of the data signal voltages for any given row of display elements is reversed in successive fields to reduce image sticking effects.

The row and column driver circuits 20 and 22 are controlled by a timing and control circuit, generally referenced at 25, to which a video signal is applied and which comprises a video processing unit, a timing signal generation unit and a power supply unit. The row drive circuit 20, like known row drive circuits, comprises a digital shift register circuit and switching circuit to which timing signals and voltages determining the scanning signal waveforms are applied. The column driver circuit 22, again like known column drive circuits, comprises one or more shift register/sample and hold circuits and is supplied from the video processing unit with video data signals derived from an input video signal containing picture and timing information. Timing signals are supplied to the circuit 22 in synchronism with row scanning to provide serial to parallel conversion appropriate to the row at a time addressing of the panel 10.

In this embodiment the non-linear devices 15 comprise MIMs. However other forms of bidirectional non-linear resistance devices exhibiting a threshold characteristic, for example diode rings, back to back diodes, or other diode structures such as n-i-n or p-i-p structures may be used instead. All such non-linear devices have an approximately symmetrical I-V characteristic.

The display device is driven using a method involving a five level row signal waveform which is similar to the method described in U.S. Pat. No. 5,159,325, to which reference is invited and whose disclosure is incorporated herein, but with certain differences as will be described later. In addition to the usual selection voltage signals followed by non-selectional voltages, this waveform further includes a reset voltage signal which immediately precedes a selection signal, and which can be regarded as an additional selection signal, for the purpose of correcting for the effects of non-uniformities in the behaviour of the non-linear devices across the array. As a result of the reset voltage, a display element is, in alternate fields, charged (this term being used herein to include discharge where appropriate) to an auxiliary voltage level beyond one end of the range of display element voltages used for display just before the display element is set to the required voltage level of the same sign, but of lower magnitude than the auxiliary voltage level, by the application of a selection voltage signal and the data voltage signal. In intermediate fields, the display element is driven with a single selection signal and an inverted data voltage signal.

Figures 2A, 2B:
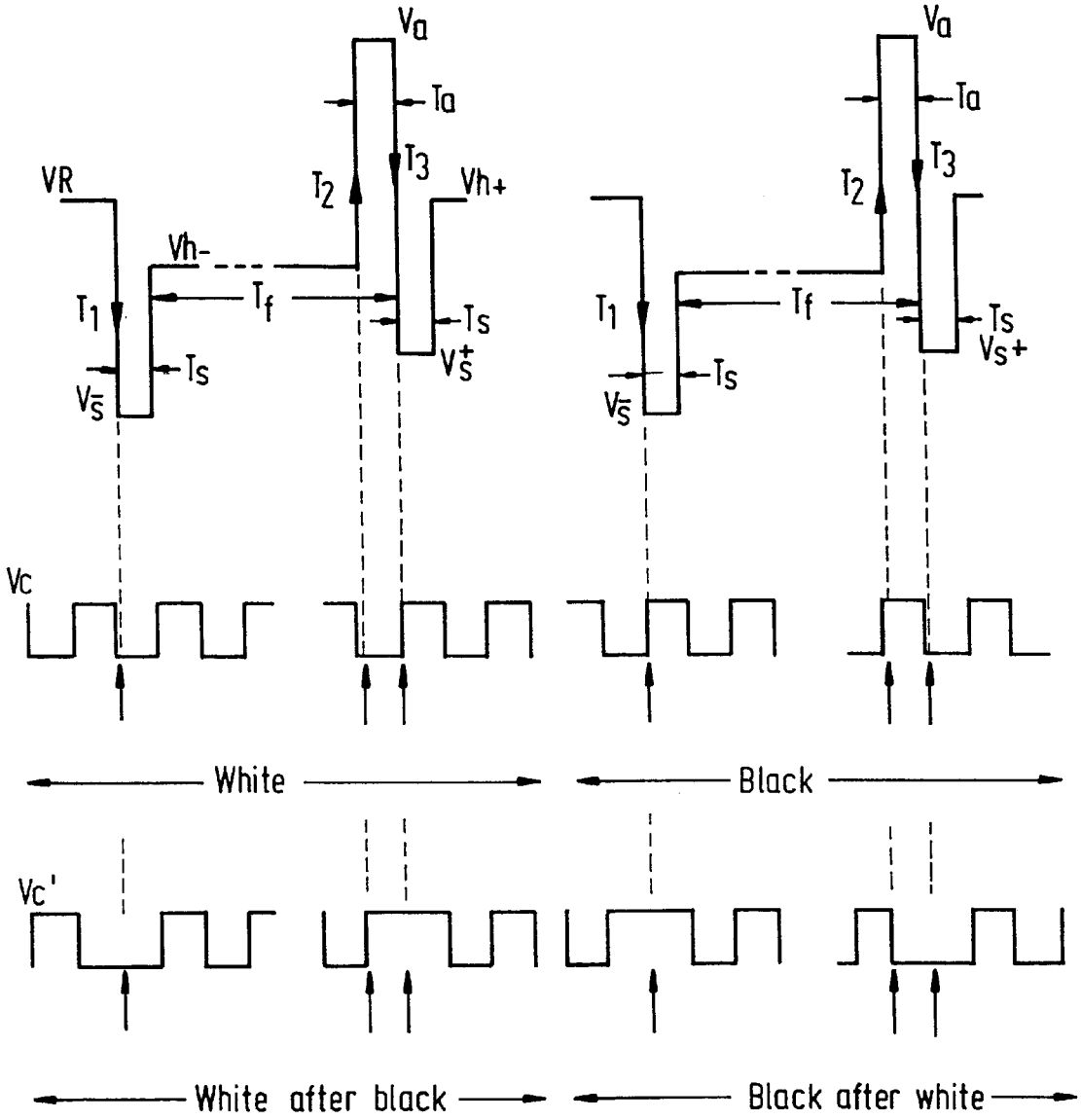
FIG. 2A PRIOR ART
FIG. 2B PRIOR ART
FIG. 2A and FIG. 2B illustrates schematically drive waveforms present in a known method of driving a display device.

Examples of waveforms present in the known drive scheme according to U.S. Pat. No. 5,159,325 are illustrated schematically in FIG. 2 for the case in which a plain field is displayed and in which the reset pulse is positive. FIG. 2A shows an example of row signal waveform, $V_R$, applied to a typical row conductor 16 together with an example of a data signal waveform in this known drive scheme, designated $V_C$, applied to a column conductor 17 associated with a particular display element in that row, for the case of a plain field display in which the display elements are all driven to a fully transmissive, white, display state corresponding to the lower end of the range of operational voltages used for display. The waveforms of FIG. 2B are similar except that they illustrate the case of a plain field display where the display elements are driven to their opaque, black, display state, corresponding to the upper end of their range of operational voltages.

In one field period a selection voltage $V_S-$ is presented to a row conductor during a row address period while a data voltage (Vd) is presented to a column conductor, with respective data voltages being applied to each of the other column conductors, as a result of which the display element at the intersection of the row and column conductors concerned is charged through the non-linear device to, for example, a positive voltage according to the level of the data signal. Upon termination of the selection signal, a non-selection, hold, level $V_h-$ is applied to the row conductor until just before the next selection of the row. To reduce visible flicker effects, information having an alternating sign is presented to a display element in successive fields. In the next field, therefore, the display element is charged to a negative voltage by presenting a selection signal. Immediately before this next selection, and in a row address period of the preceding row of display elements, a reset voltage Va is applied as a result of which the display element is charged negatively through the non-linear device to an auxiliary voltage, dependent on the reset voltage level, which lies at or beyond the range of operating voltages used for display (i.e. up to a value less than or equal to Vsat, its black level). The display element is then charged, in the next field period, to the desired value by means of a selection voltage signal Vs+ applied to the row conductor in the subsequent row address period while an inverted data voltage, (−Vd), is presented to the column conductor. Upon termination of this selectional signal, a non-selection, hold, level Vh+ is applied. In this way, the voltage across the display elements is inverted every field. The selected display elements are then charged to the required voltages, at which a desired display state is obtained, by passing current in the same direction through the non-linear devices, while the passage of current when the display elements are charged to the auxiliary level is in the opposite direction.

The duration Ts of each of the selection pulse signals Vs− and Vs+ is slightly less than the line period T1 of the incoming video signal, e.g. 32 microseconds for a data-graphic display, which corresponds to the row address period. The duration of the reset voltage pulse signal Va is also slightly less than T1. Tf in FIG. 2 represents a field period, e.g. approximately 16 ms.

Figure 3:
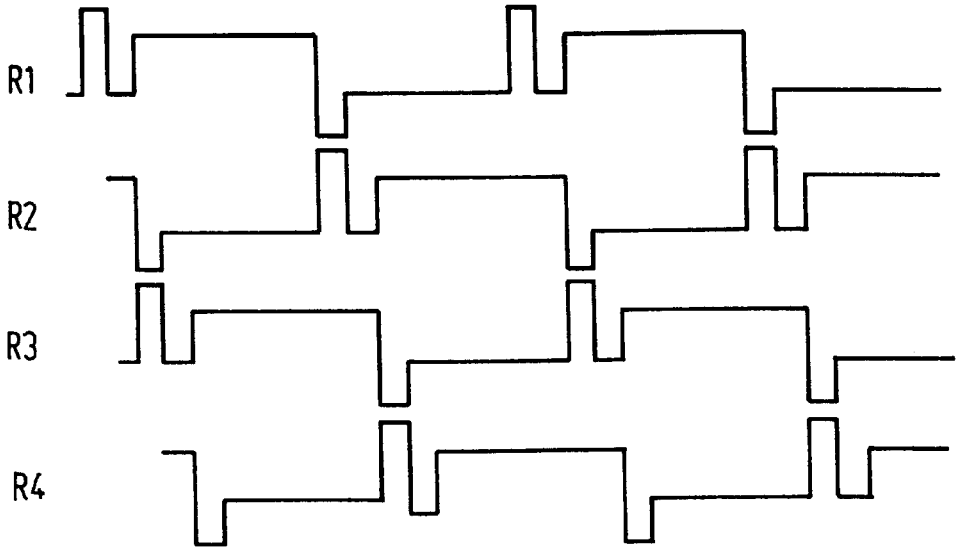
FIG. 3 illustrates schematically row signal waveforms applied to successive rows of display elements in this known method.

In this drive scheme, the display elements are driven in a line inversion mode of operation in which, in addition to the column drive voltages applied to a display element being reversed in polarity every field, the drive voltages applied to one row of display elements are shifted over one field period plus a row address period with respect to those for an adjacent row and the data signals are inverted for successive rows. This is illustrated in FIG. 3 which shows the row signal waveforms for four successive row conductors, R1 to R4. The data signals on the column conductors are inverted correspondingly, as shown in FIGS. 2A and 2B.

In these example waveforms, the reset voltage pulse Va is positive. The sign of all the operating voltages, including the reset pulse and the data signals, applied to a row of display elements can periodically be changed if desired, for example after a fixed number of frames as described in U.S. Pat. No. 5,159,325.

In this known drive scheme there are three transitions in the row signal waveform during which large peak current flows can occur in the non-linear devices, namely the leading edges of the negative selection pulse Vs−, in one field and the reset pulse Va, and the positive selection pulse $V_{S+}$ in the succeeding field. These transitions are denoted in FIG. 2 at T1, T2 and T3 respectively. The peak current is determined by the value of the column signal $V_C$ at the time of the relevant transition and the voltage on the display element immediately prior to the transition. The situation is summarised in Table 1 below for the case where the reset pulse voltage level is set exactly at its ideal theoretical value. The total charge which must be transferred onto the display element during the transition is an indication of the peak current. This charge is proportional to both the change in the display element voltage during the transition and the display-element capacitance. Voltages are expressed in terms of $V_W$ and $V_B$ which are the voltages on the display elements required to drive the LC fully white and fully black. The corresponding display element capacitances are $C_W$ and $C_B$.

TABLE 1

Plain Field

| Display Element | Row Signal Transition | Initial Voltage | Final Voltage | Voltage change | Display Element Capacitance | Charge |
|---|---|---|---|---|---|---|
| White | $T_1$ | $+V_W$ | $-V_W$ | $-2V_W$ | $C_W$ | $-2C_WV_W$ |
| White | $T_2$ | $-V_W$ | $2V_B - V_W$ | $+2V_B$ | $C_W$ | $+2C_WV_B$ |
| White | $T_3$ | $2V_B - V_W$ | $+V_W$ | $-2V_B + 2V_W$ | $C_W$ | $-2C_W(V_B - V_W)$ |
| Black | $T_1$ | $+V_B$ | $-V_B$ | $-2V_B$ | $C_B$ | $-2C_BV_B$ |
| Black | $T_2$ | $-V_B$ | $+V_B$ | $+2V_B$ | $C_B$ | $+2C_BV_B$ |
| Black | $T_3$ | $+V_B$ | $+V_B$ | 0 | $C_B$ | 0 |

The total charges, Q, flowing through the non-linear device, irrespective of direction, are:

$$Q \text{ (white display element)} = 4C_WV_B \text{ and}$$

$$Q \text{ (black display element)} = 4C_BV_B \quad (1)$$

This shows that for a five level level row signal drive scheme the difference in the total charge through the non-linear device in each complete cycle between black and white picture elements is due only to the difference in capacitance and not to any difference in column voltage. In practice the reset pulse voltage may be set to a slightly higher value than the simple ideal value which drives a picture element just to black when the column voltage is $V_B$. This alters the total charge passing through the non-linear device but the difference between black and white picture elements still depends only on the difference in their capacitance and not on the difference between $V_B$ and $V_W$.

The above discussion applies to a plain field display. The situation for a display having black and white regions will now be considered.

At the junction between a region of black display elements and a region of white display elements the charge balance is different from that described above. This situation is illustrated in the lower parts of FIGS. 2A and 2B by the new column voltage signal $V_{C'}$ now present, respectively, for a white display element just below a black region of the display and a black display element just below a white region of the display. In this case the voltage changes and charges are as indicated in the following Table:

TABLE 2

Black/White Edge Regions

| Display Element | Row Signal Transition | Initial Voltage | Final Voltage | Voltage change | Display Element Capacitance | Charge |
|---|---|---|---|---|---|---|
| White | $T_1$ | $+V_W$ | $-V_W$ | $-2V_W$ | $C_W$ | $-2C_WV_W$ |
| White | $T_2$ | $-V_W$ | $+V_B$ | $V_B + V_W$ | $C_W$ | $C_W(V_B + V_W)$ |
| White | $T_3$ | $+V_B$ | $+V_W$ | $V_W - V_B$ | $C_W$ | $-C_W(V_B - V_W)$ |
| Black | $T_1$ | $+V_B$ | $-V_B$ | $-2V_B$ | $C_B$ | $-2C_BV_B$ |
| Black | $T_2$ | $-V_B$ | $2V_B - V_W$ | $3V_B - V_W$ | $C_B$ | $C_B(3V_B - V_W)$ |
| Black | $T_3$ | $2V_B - V_W$ | $+V_B$ | $V_W - V_B$ | $C_B$ | $-C_B(V_B - V_W)$ |

If the total charge flowing through the non-linear device is considered, irrespective of direction, then the values are:

$$Q(\text{White display element}) = (2V_B + 2V_W)CW \text{ and}$$

$$Q(\text{Black display element}) = (6V_B - 2V_W)CB \quad (2)$$

It is apparent, therefore, that in this case the charges for the black and white display elements are significantly different and are also different from the plain field case. It is clear that the non-linear devices associated of picture elements at the edges of black and white zones in the image will tend to age at a different rate from those in the middle of plain areas of the image. Thus, when line inversion and a five-level row signal waveform are used, the differences in ageing rate for the non-linear devices of black and white display elements in the middle of plain areas of the image are determined only by the differences in capacitance of these display elements, but the non-linear devices of picture elements at the horizontal transitions between black and white regions, or vice versa, may age much more or much less than those of other picture elements. In display panels aged by displaying a chequerboard pattern this effect has been observed as a series of darker and lighter lines at the horizontal edges of the chequerboard when the display is subsequently examined using a conventional 4-level row drive waveform. In 5-level drive these areas show greater flicker levels.

The edge effects are significant for datagraphic displays where fixed geometric patterns can be present for long periods.

These effects are significantly reduced by using the method of driving the display device according to the present invention. The method is similar to that described above but with certain modifications to the row and column drive signals. In particular, it involves alterations to the timing of the presentations of data and inverted data signals. By appropriate adjustment of these timings and the timings of the selection and reset voltages of the row waveform it can be arranged that data inversion is used to reduce the problem of differential ageing of non-linear devices of the display elements at the edge of black and white regions to be overcome. The data inversion is then such that the ageing behaviour of these non-linear devices is the same as for the plain field case illustrated in FIGS. 2A and 2B since each data signal is followed by its inverse.

Figure 4:
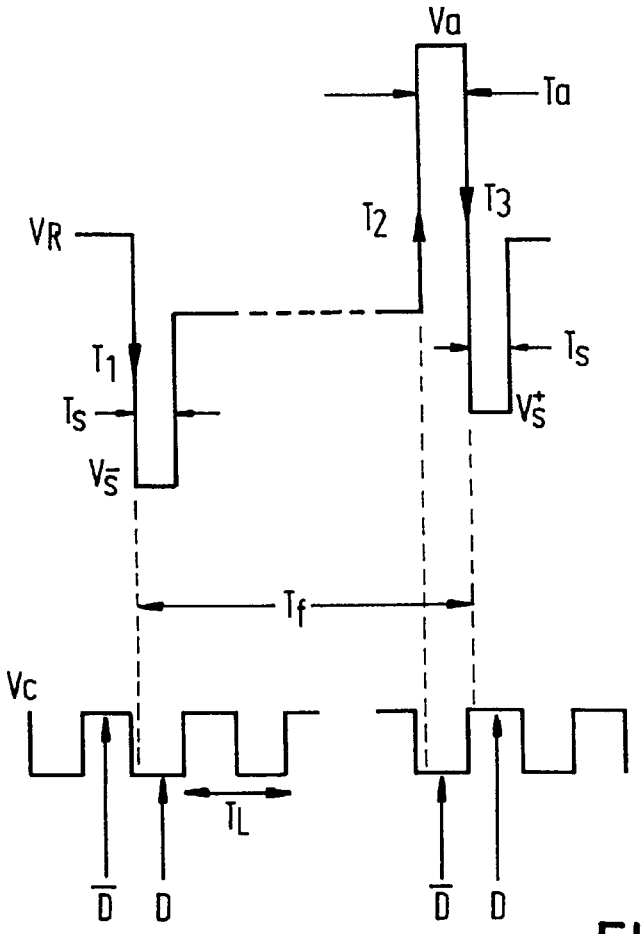
FIG. 4 illustrates schematically examples of drive waveforms in operation of the display device according to the method of the present invention.

An embodiment of this method of driving the display device is illustrated by FIG. 4 which shows examples of the row signal waveform and data signal waveform, $V_R$ and $V_C$, applied to typical row and column conductors of the array for the case of a plain field (white) display.

In this method the column drive circuit 22 is arranged to provide data inversion in a row address period, that is, the output signal to a column conductor 17 is first applied to the column conductor for a predetermined period with one polarity and is then re-applied for a, preferably, equal period with the inverse polarity. As before, $T_1$ represents a row address period, corresponding to a line period of the applied video signal. D and $\overline{D}$ respectively are the data and inverse data signal. Each polarity of the data signal is applied in this example for half the overall row address period, $T_1$. The duration of each of the selection and reset signals, Vs−, Vs+ and Va, is slightly less than one half of the row address period, i.e. Ts=Ta<T1/2.

The selection pulse signal Vs− occurs during the second half of the data, row address period, that is, after the column signal has carried inverted data signal $\overline{D}$ and while the normal data signal D is present.

Also, the timing of the reset pulse signal Va is such that its leading edge occurs during the first half of the column data period, that is, while the column conductor is carrying the inverted data signal $\overline{D}$. The selection signal Vs+ then occurs during the application of the data signal D to the column conductor.

It is preferred to use data and inverted data signals of substantially equal duration as this is most effective for reducing cross-talk effects.

Using this approach the ageing of all non-linear devices, no matter what the displayed image, will depend only on the display element capacitance and not on the current drive voltage. As a result the difference in ageing between the non-linear devices will be much less dependent on image content than that normally encountered using 5-level row drive signals and line inversion. This enables much more accurate compensation of the ageing effects by means of the kind of technique described in European Patent Specification EP-A-0523797 using a reference non-linear device driven at an appropriate reference level. In particular, if storage capacitors are incorporated in the display so that the display element capacitance is only very slightly dependent on the drive level, the non-linear devices of all display elements will age substantially equally and very accurate compensation is possible.

The matrix display device may be a colour display device and references in the preceding description to black and white display elements should be construed accordingly. Moreover, although the method has been described in relation to a display device comprising a liquid crystal display device, it is envisaged that the method can be used with display devices employing other kinds of electro-optic materials, for example, electrochromic or electrophoretic materials.

From reading the present disclosure, other modifications will be apparent to persons skilled in the art. Such modifications may involve other features which are already known in the field of matrix display apparatus and their methods of driving and which may be used instead of or in addition to features already described herein.

What is claimed is:

1. A method of driving a matrix display device comprising sets of row and column address conductors, a row and column array of electro-optic display elements operable to produce a display, each of which is connected in series with a two terminal non-linear device between a row conductor and a column conductor, in which each row of display elements is driven by applying during a respective row address period a selection voltage signal to a row conductor to select the row of display elements and data voltage signals to the column conductors to drive each display element to produce a required display effect, in which, prior to the application of a selection voltage signal and a data voltage signal which are operable to charge a selected display element to a voltage of predetermined sign and magnitude at which the required display effect is obtained, the display element is charged to an auxiliary voltage of the same sign and greater magnitude, characterised in that during a respective row address period the data voltage signal for a display element is applied during a latter part of the respective row address period and a signal comprising a the inverse of the data signal is applied during a preceding part of the respective row address period with the display element being driven to said auxiliary voltage during the application of the inverse data signal in the respective row address period, in that the selection voltage signal is applied during the application of said data signal in the latter part of the respective row address period and in that the duration of the selection voltage signal and the duration of the inverse data signal are each close to, but less than, one half of the respective row address period.

2. A method according to claim 1, characterised in that the data signal and the inverse data signal are applied for substantially equal periods during a respective row address period.

3. A method according to claim 2, characterised in that the array of display elements is driven in a line inversion mode of operation in which the drive voltages applied to one row of display elements are shifted over one field period plus a row address period with respect to those for an adjacent row of display elements and the data signals are inverted for successive rows.

4. A method according to claim 1, characterised in that the array of display elements is driven in a line inversion mode of operation in which the drive voltages applied to one row of display elements are shifted over one field period plus a row address period with respect to those for an adjacent row of display elements and the data signals are inverted for successive rows.

5. A method according to claim 1, characterised in that the display elements comprise liquid crystal display elements.

6. A matrix display device comprising sets of row and column address conductors, a row and column array of electro-optic display elements for producing a display, each of which display elements is connected in series with a two terminal non-linear device between a row conductor and a column conductor, and a drive circuit connected to the sets of row and column address conductors for applying a selection voltage signal to each row address conductor during a respective row address period to select the row of display elements and data voltage signals to the column conductors to drive each display element to produce a required display effect, and in which the drive circuit is arranged also to charge a display element to an auxiliary voltage prior to the application to that display element of a selection voltage signal and a data voltage signal for driving the selected display element to a voltage of predetermined sign and magnitude to obtain the required display effect, which auxiliary voltage is of the same sign and greater magnitude, characterised in that the drive circuit is arranged to apply in a row address period the data voltage signal for a display element and the inverse of the data signal to its associated column address conductor during respectively a latter part of the respective row address period and a preceding part of the respective row address period, the drive circuit being operable to charge the display element to said auxiliary voltage during the application of the inverse data signal in the respective row address period and to apply the selection voltage signal during the application of said data signal in the latter part of the respective row address period, the duration of the selection voltage signal and the duration of the inverse data signal each being close to, but less than, one half of the respective row address period.

7. A matrix display device according to claim 6, characterised in that the drive circuit is operable to apply the data signal and the inverse data signal for substantially equal periods during the respective row address period.

8. The matrix display device of claim 6 wherein the array of display elements is driven in a line inversion mode of operation in which the drive voltages applied to one row of display elements are shifted over one field period plus a row address period with respect to those for an adjacent row of display elements and the data signals are inverted for successive rows.

9. The matrix display device of claim 6 wherein the display elements comprise liquid crystal display elements.

10. A matrix display device comprising sets of row and column address conductors, said row conductors and said column conductors being provided on two separate plates, a row and column array of electro-optic display elements for producing a display, each of which display elements is connected in series with a two terminal non-linear device between a row conductor and a column conductor, and a drive circuit connected to the sets of row and column address conductors for applying a selection voltage signal to each row address conductor during a respective row address period to select the row of display elements and data voltage signals to the column conductors to drive each display element to produce a required display effect, and in which the drive circuit is arranged also to charge a display element to an auxiliary voltage prior to the application to that display element of a selection voltage signal and a data voltage signal for driving the selected display element to a voltage of predetermined sign and magnitude to obtain the required display effect, which auxiliary voltage is of the same signal and greater magnitude, characterised in that the drive circuit is arranged to apply in a respective row address period the data voltage signal for a display element and the inverse of the data signal to its associated column address conductor during respectively a latter part of the respective row address period and a preceding part of the respective row address period, the drive circuit being operable to charge the display element to said auxiliary voltage during the application of the inverse data signal in the respective row address period and to apply the selection voltage signal during the application of said data signal in the latter part of the respective row address period, the duration of the selection voltage signal and the duration of the inverse data signal each being close to, but less than, one half of the respective row address.

11. A matrix display device comprising respective sets of row and column address conductors, a row and column array of electro-optic display elements for producing a display, each of which display elements is connected in series with a two terminal non-linear device between a row conductor and a column conductor, and a drive circuit connected to the sets of row and column address conductors for applying a selection voltage signal to each row address conductor during a respective row address period to select the row of display elements and data voltage signals to the column conductors to drive each display element to produce a required display effect, and in which the drive circuit is arranged also to charge a display element to an auxiliary voltage prior to the application to that display element of a selection voltage signal and a data voltage signal for driving the selected display element to a voltage of predetermined sign and magnitude to obtain the required display effect, which auxiliary voltage is of the same sign and greater magnitude, characterised in that the drive circuit is arranged to apply in a respective row address period the data voltage signal for a display element and the inverse of the data signal to its associated column address conductor during respectively a latter part of the respective row address period and a preceding part of the respective row address period, the drive circuit being operable to charge the display element to said auxiliary voltage during the application of the inverse data signal in the respective row address period and to apply the selection voltage signal during the application of said data signal in the latter part of the respective address period, the duration of the selected voltage signal and the duration of the inverse data signal each being close to, but less than, half of the respective row address period.

* * * * *